US006363684B1

(12) United States Patent
Alderman et al.

(10) Patent No.: US 6,363,684 B1
(45) Date of Patent: Apr. 2, 2002

(54) METHOD OF DISPENSING NETTING FOR A ROOF STRUCTURE

(75) Inventors: Robert J. Alderman, Canyon Lake; James E. Taylor, Seguin, both of TX (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/602,998

(22) Filed: Jun. 23, 2000

Related U.S. Application Data

(60) Provisional application No. 60/141,428, filed on Jun. 29, 1999.

(51) Int. Cl.[7] ..... E04D 5/08

(52) U.S. Cl. ..... 52/742.12; 52/749.12; 52/745.06; 52/741.3; 52/407.4; 52/404.3

(58) Field of Search ..... 52/749.12, 742.12, 52/745.06, 741.3, 407.3, 407.4, 404.3, 404.5, 501.01

(56) References Cited

U.S. PATENT DOCUMENTS 1,671,946 A * 5/1928 Govan ..... 52/745.06
4,047,346 A * 9/1977 Alderman ..... 52/407.4
4,557,092 A * 12/1985 Brueske ..... 52/404.1
4,967,535 A 11/1990 Alderman
5,251,415 A 10/1993 Van Auken et al.
5,406,764 A 4/1995 Van Auken et al.
5,551,203 A * 9/1996 Alderman et al. ..... 52/746.11
5,653,081 A 8/1997 Wenrick et al.
5,664,740 A 9/1997 Alderman et al.
5,778,628 A 7/1998 Pendley
5,901,518 A * 5/1999 Harkins ..... 52/404.3
6,056,231 A * 5/2000 Neifer et al. ..... 52/749.12 X
6,094,883 A * 8/2000 Atkins ..... 52/746.11

* cited by examiner

*Primary Examiner*—Beth A. Stephan
*Assistant Examiner*—Brian E. Glessner
(74) *Attorney, Agent, or Firm*—Stephen W. Barns; Inger H. Eckert

(57) ABSTRACT

A method of providing a roof structure having a plurality of purlins spaced apart from one another in a parallel arrangement includes the first step of providing a carriage upon which is mounted a supply of support sheet and a supply of netting. A first section of the roof structure is then constructed. The first section includes purlins, the support sheet, and the netting. The carriage is then moved along the length of the purlins in a direction away from the completed first section of the roof structure, wherein movement of the carriage dispenses the support sheet and the netting.

22 Claims, 5 Drawing Sheets

METHOD OF DISPENSING NETTING FOR A ROOF STRUCTURE

CROSS REFERENCE TO RELATED APPLICATIONS

This application claims the benefit of U.S. Provisional Application No. 60/141,428 filed Jun. 29, 1999.

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Buildings having metal roof structures typically comprise a series of parallel rafter beams which are supported by vertical columns extending from the floor of the building. A plurality of spaced apart purlin beams extend in a direction normal to the rafter beams and are fastened to top portions of the rafter beams. Typically, the roofs generally have two sloped sections, each extending from a side of the building to a peak. To enclose the roof structure, sheets of hard roofing material, such as metal deck sheets can be used to cover the roof structure. The deck sheets are typically interlaced and fastened to the purlins.

Ordinarily, the roof structures include some type of insulation material placed above or below the deck sheets to provide thermal insulation for the building. In one type of insulated roof structure, insulation material in long sheets is placed in the area between purlins. The sheets of insulation material can be laid along the length of the purlins or across the purlins in a direction normal to the purlins. The insulation material is supported between the purlins beneath the hard roofing material. Various methods of supporting the insulation material have been used. Mounting straps or wire mesh which are attached to or draped over the purlins forming a lattice have been used. A facing or sheet, typically made of vinyl and acting as a vapor barrier, is then rolled onto the lattice, and insulation material is placed between adjacent purlins and over the sheet. Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins.

Of considerable importance to the construction of roof structures, is the safety of the workers. For roof structures which are built using the carriage as described above, it has been known to provide a platform which extends from the carriage in a direction towards the completed section of the roof and is pulled along with the carriage, such as that disclosed in U.S. Pat. No. 5,664,740 to Alderman et al. The platform extends underneath the purlins and supports the support sheet as it is loosely draped between adjacent purlins. The platform can be built of sufficient strength so as to support a worker stepping or falling onto the platform. However, the roof structures often include purlin support bracing and straps which extend between adjacent purlins. To accommodate the bracing, the platform is positioned near the top of the purlins so that the platform will not be obstructed by the bracing as the carriage moves. Thus, the support sheet is relatively flat across the tops of the purlins and does not hang down into the space between the purlins. Insulation material placed on top of the support sheet is then compressed when the hard roofing material is attached to the purlins. The use of platforms sufficiently built to support a worker adds weight to the carriage which may deform the purlins upon which the carriage is mounted.

In the past, permanent netting has been provided under the workers on top of the roof structure to help prevent the workers from falling between the purlins and to catch dropped objects, such as tools. U.S. Pat. No. 5,251,415 to Van Auken et al. discloses such a netting and method of installation. The netting is typically supplied in 30 feet wide sheets, which is the typical width between adjacent rafter beams. The netting can span the entire roof and can be placed in a secure but loose manner to support insulation material placed on top to provide space for the insulation material. When the insulation material and the deck sheets are installed above the netting, the netting becomes a permanent structure of the roof. To install the netting, the roll of netting is generally positioned on the ground with its axis parallel to the purlins. The leading edge of the netting is pulled up over the edge of the roof by workers which stand on top of the rafter beams. The workers then walk along the tops of the rafter beams and drag the netting across the purlins, so that the netting is laid longitudinally across the purlins from one edge of the building to the other. The netting is generally supplied in widths approximately equal to the expanse between rafter beams, commonly 30 feet so that the edges of the netting are positioned above a rafter beam. The edges of adjacent netting are fastened together, such as by use of tie straps or other fasteners to provide an edge to edge fastening strength as great as that of the netting itself. The netting is then secured to the roof structure by periodically strapping portions of the netting to purlins and rafter beams. Since the workers move along the rafter beams during the installation of the netting, there is a danger of falling off of the roof structure outside of the secured netting. To protect the workers, they are secured by lines or cords secured to the rafter beams and/or purlins. As the workers move along the rafter beams installing the netting, they must constantly change the connection point of the cord, which can be dangerous and time consuming.

Another method of installing the netting is to construct scaffolding underneath the roof structure to provide a platform for the workers installing the netting. Alternatively, lifting equipment can be used to hoist the workers up to the top of the roof structure to install the netting. However, the use of lifting equipment and scaffolding can be relatively expensive and time consuming.

It is also known to dispense netting onto a roof structure with the aid of a sled, such as that disclosed in U.S. Pat. No. 5,778,628 to Pendley. The sled includes a distribution box that holds a roll netting. The box has an open end through which the netting is dispensed. The sled includes a pair of spaced apart parallel rails for sliding along the tops of the purlins. The rails have a length which is longer than two purlin spans to prevent the sled from falling therebetween. To dispense the netting, the sled is positioned across the purlins and pulled by a rope in a direction perpendicular to the purlins. As the sled is moved, the netting is dispensed from the open end of the box. The width of the netting is preferably sized to correspond with the width of the bays of the roof, i.e., the width between the rafter beams. The netting is then secured to the roof structure by periodically strapping portions of the netting to purlins and/or rafter beams. Since the workers move along the rafter beams during the installation of the netting, there is a danger of falling off of the roof structure outside of the secured netting. If the roof structure were to include fibrous insulation, the insulation is installed on top of the netting between adjacent purlins. Preferably, the netting is not taut between the purlins, but rather sags therebetween to provide vertical space for the fibrous insulation material. It is difficult to accomplish this sagging by the use of the sled since the sled is pulled along a direction perpendicular to the purlins.

It would be desirable to have a system of building roof structures which is simple and less time consuming to use, and which provides adequate protection from falling objects and for the workers constructing the roof.

SUMMARY OF THE INVENTION

The above objects as well as other objects not specifically enumerated are achieved by a method of providing a roof structure having a plurality of purlins spaced apart from one another in a parallel arrangement. The method includes the first step of providing a carriage upon which is mounted a supply of support sheet and a supply of netting. A first section of the roof structure is then constructed. The first section includes purlins, the support sheet, and the netting. The carriage is then moved along the length of the purlins in a direction away from the completed first section of the roof structure, wherein movement of the carriage dispenses the support sheet and the netting.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
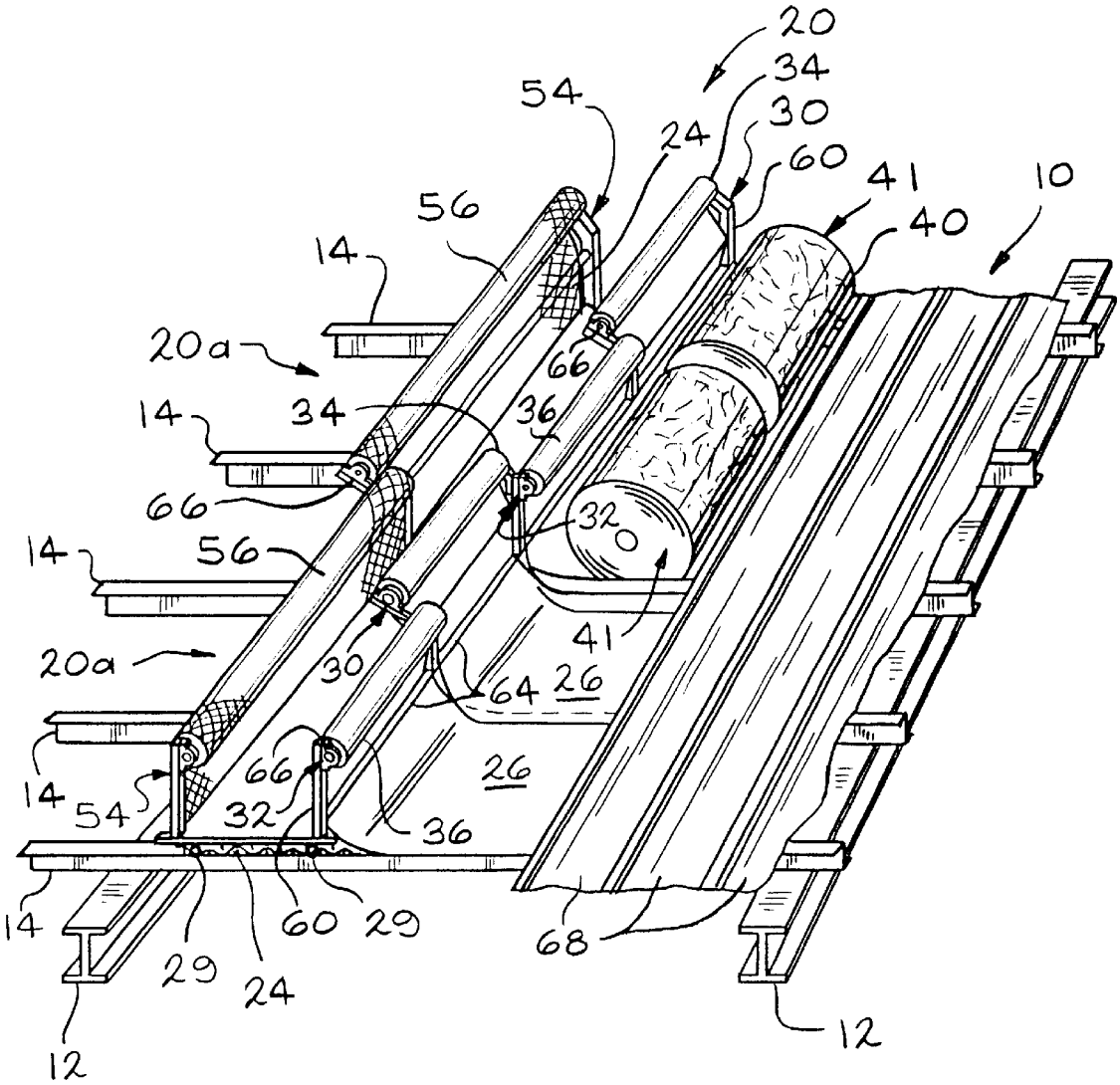
FIG. 1 is a perspective view of a carriage traveling along a roof structure dispensing a netting and support sheet, in accordance with the present invention.
Figure 2:
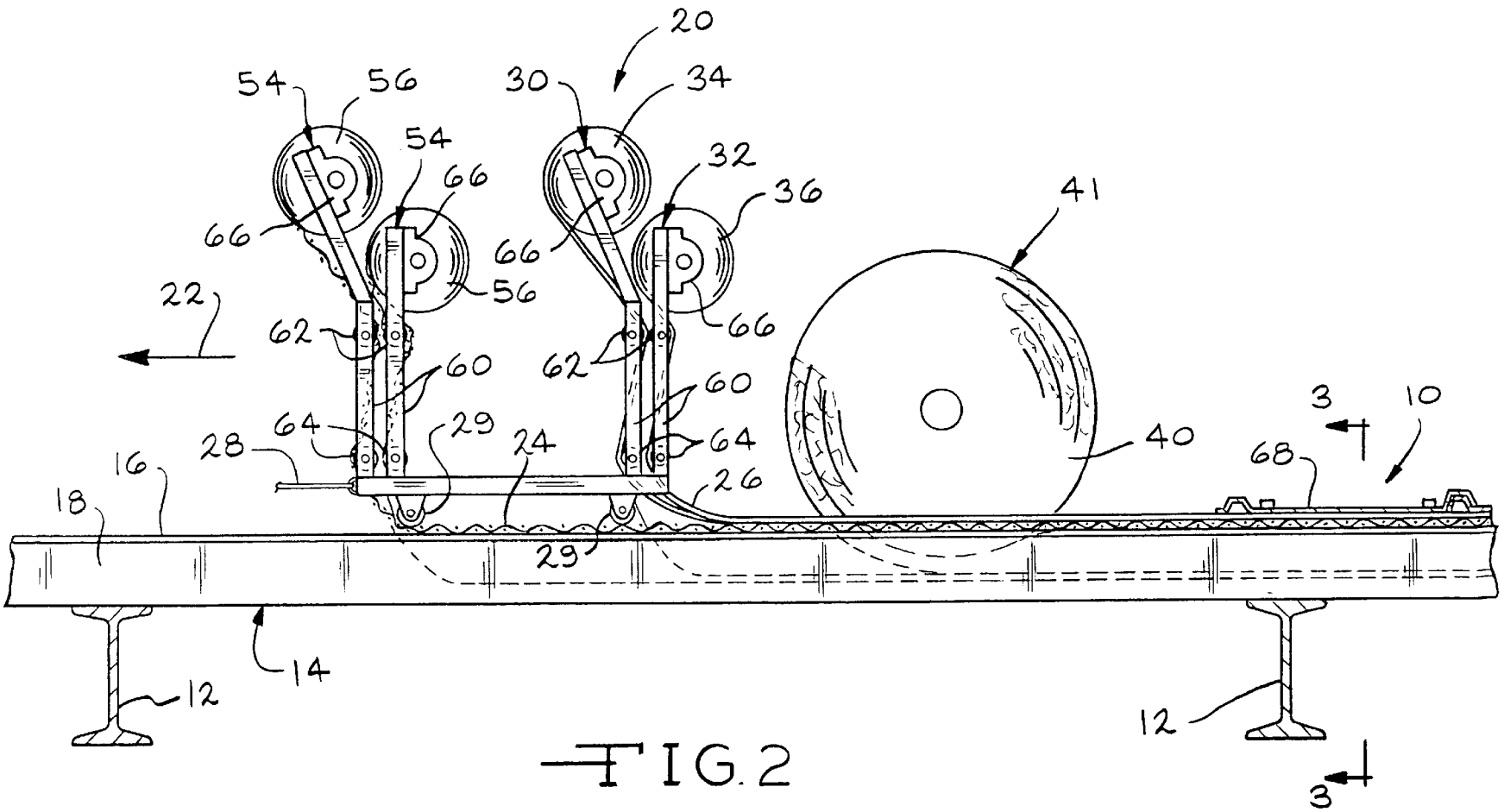
FIG. 2 is a side elevational view of the roof structure and carriage of FIG. 1.

Referring now to the drawings, there is illustrated in FIGS. 1 and 2 a building roof structure, indicated generally at 10. The roof structure is typically supported by main rafter beams 12 which are positioned parallel to each other. A plurality of purlins 14, spaced apart and arranged parallel to each other, are fastened on top of the rafters in a direction normal to the rafters. The purlins have a generally Z-shaped cross-section and include a top portion 16 and a vertical portion 18. The spacing of the purlins is typically 5 feet (1.52 meters) on centers. Roof structures may also be constructed from bar joists or trusses, and the invention as described herein will work equally well with purlins, bar joists or trusses. The use of the term "purlins" in this specification and claims includes not only traditional purlins, but also bar joists and trusses and other similar structural members.

FIGS. 1 and 2 illustrate a first method of providing the roof structure 10 by use of a carriage, indicated generally at 20. The carriage rides on top of the purlins 14 and travels along the length of the purlins in a first direction, indicated by an arrow 22, as shown in FIG. 2. As will be explained in detail below, the roof structure 10 is constructed by moving the carriage in the first direction to dispense a plurality of lengths of netting 24 and support sheets 26. The carriage 20 can be any suitable apparatus that rides along the top of the purlins for dispensing the support sheet and netting. The carriage can be propelled along the roof structure by any suitable pulling means, such as by a winch (not shown) and a cable 28 fastened to the other end of the roof structure. The carriage can also be propelled by a powered puller assembly (not shown) which rides along the purlins pulling the carriage along with it. The carriage preferably has rollers 29 rotatably mounted thereon to roll along the upper portions of the purlins. The carriage can be any length up to the width of the roof itself. As shown in FIG. 1, the carriage 20 is preferably comprised of a plurality of carriage sections 20*a* which can be joined together so that they span the entire width of the roof. Note that FIG. 1 shows two carriage sections 20*a*. Although the illustrated carriage sections 20*a* cover two purlin spans, as shown in FIG. 1, the carriage sections 20*a* can be configured to cover any suitable number of purlin spans.

Figure 3:
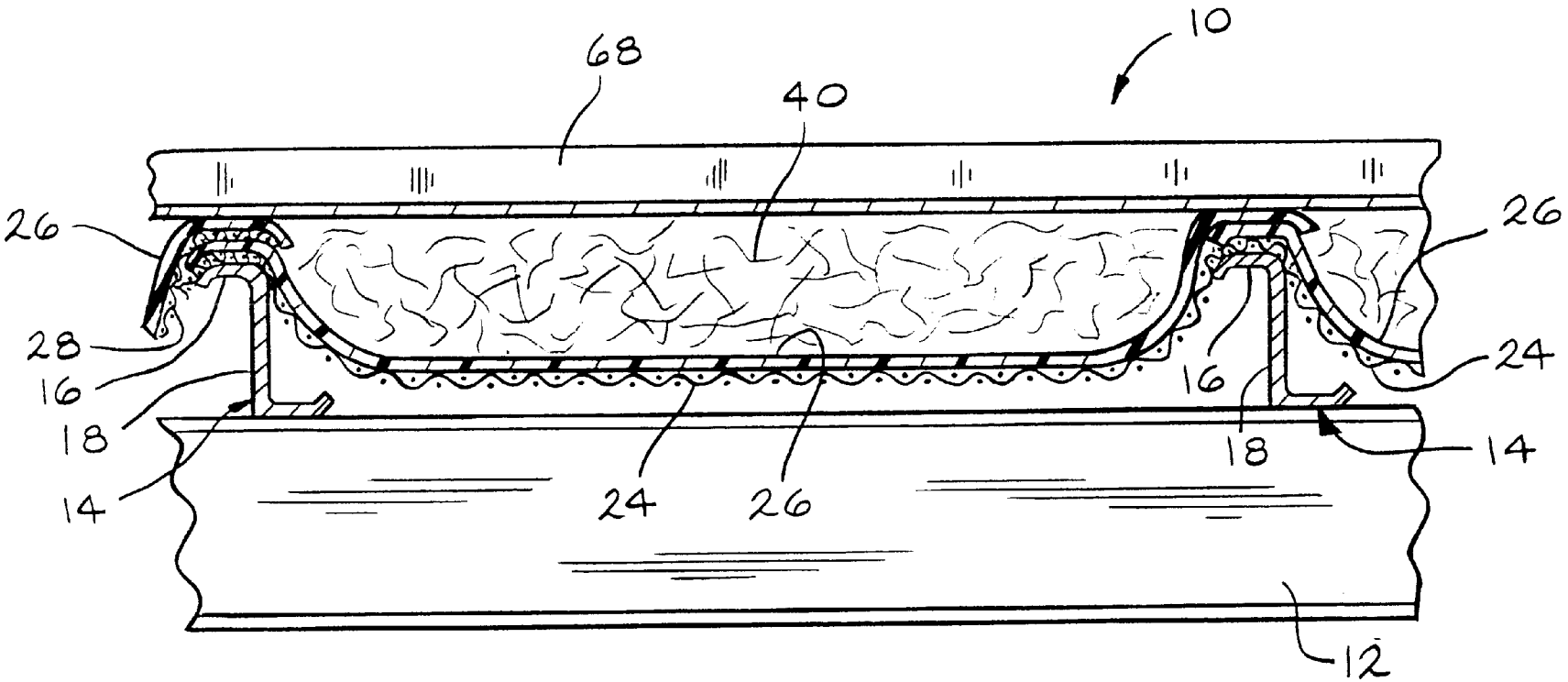
FIG. 3 is a sectional view of the roof structure taken along Lines 3—3 of FIG. 2.

Each carriage section 20*a* preferably includes a pair of support sheet dispensers, indicated generally at 30 and 32, which are mounted on the carriage sections 20*a*. The dispenser 30 supports a leading roll 34 of support sheet 26, and the dispenser 32 supports a trailing roll 36 of support sheet 26. As the carriage moves in the first direction 22, the support sheets 26 are dispensed from the rolls 34 and 36 and are draped on top of adjacent purlins 14 so that the support sheets depend from the upper portions 16 of the purlins 14. In the embodiment of the carriage 20 illustrated in FIG. 3, the width of the support sheet is sized slightly larger than the distance between adjacent purlins so that the longitudinal edges of the support sheet are positioned on top of adjacent purlins and the support sheet sags between adjacent purlins. As best shown in FIG. 3, the sagging of the support sheets provides space for fibrous insulation material 40 placed on top of the support sheets 26. Because the support sheets are draped across adjacent purlins, the width of the support sheets is wider than the distance between the purlins. Therefore, adjacent support sheet rolls are not co-linear and are placed in a slightly staggered orientation. By incorporating a staggered leading roll 34 and a trailing roll 36 on a carriage section 20*a*, multiple carriage sections 20*a* can be joined together, with every dispenser being staggered from an adjacent dispenser.

The support sheets 26 can be any suitable material, such as vinyl, which supports the insulation material between the purlins. The support sheets can also be used as a vapor barrier and/or for aesthetic appearances.

The insulation material 40 can be any suitable insulation material, such as flexible non-woven fibrous material. The insulation material 40 preferably extends between the vertical portions 18 of the purlins 14. Preferably, the insulation material is supplied in rolls 41, as shown in FIG. 1, which are unrolled as the carriage 20 moves in the first direction 22. Alternatively, the insulation material can be applied laterally across the purlins on top of the support sheets 26.

Instead of supplying rolls of support sheet having a width which is larger than the distance between adjacent purlins, the rolls of support sheet can be provided having longitudinal folds or pleats (not shown) formed therein. As the support sheets are dispensed, the pleats unfold, thereby expanding the width of the support sheet, such as shown and described in U.S. Pat. No. 5,653,081 to Wenrick et al., which is hereby incorporated by reference. By expanding the width of the support sheet, the support sheet, and consequently, the insulation material itself, can more uniformly fill the generally rectangular area between the vertical portions 18 of adjacent purlins 14. Supplying the rolls of support sheet with longitudinal folds may also decrease the width of the roll so that staggering of a leading roll and a trailing roll is unnecessary.

The carriage 20 also preferably includes netting dispensers, indicated generally at 54, mounted thereon. The dispenser 54 can be any suitable structure which supports a supply of netting and allows the netting to be dispensed when the dispenser 54 is 20 moved. For example, the dispenser 54 can be configured to support a roll 56 of netting 24. As the carriage moves in the first direction 22, the netting is dispensed from the roll 56 and is draped on top of the purlins 14, in a similar manner as the support sheets. The netting is preferably dispensed so that it sags between adjacent purlins like the support sheet 26 to accommodate the insulation material 46. It is also preferable that the netting and support sheet are dispensed in a uniform manner so that the sag between all of the purlin spans is uniform to accommodate the height of the insulation material positioned on top thereof. The dispensing of the netting and support sheet in a direction parallel to the purlins helps to insure this uniform dispensing, as compared to dispensing the netting and support sheet across the purlins. Preferably, the netting 24 is dispensed underneath the support sheets 26. Of course, the carriage could be configured to dispense the netting so that the netting is positioned on top of the support sheet. In the embodiment of the carriage 20 illustrated in FIG. 1, each carriage section 20*a* includes a single dispenser 54 for supporting a roll 56 of netting 24. Although the width of the roll 56, as shown in FIG. 1, is approximately two purlin spans, it should be understood that the width of the netting can be any suitable width, up to the entire width of the roof structure 10. If each carriage section 20*a* includes a roll of netting, as shown in FIG. 1, the dispensers 54 can be mounted on the carriage in a staggered manner to accommodate the width of the rolls of netting. Alternatively, the netting can be provided having longitudinal pleats or folds, in a similar manner as the support sheet, as described in U.S. Pat. No. 5,653,081.

Figure 5:
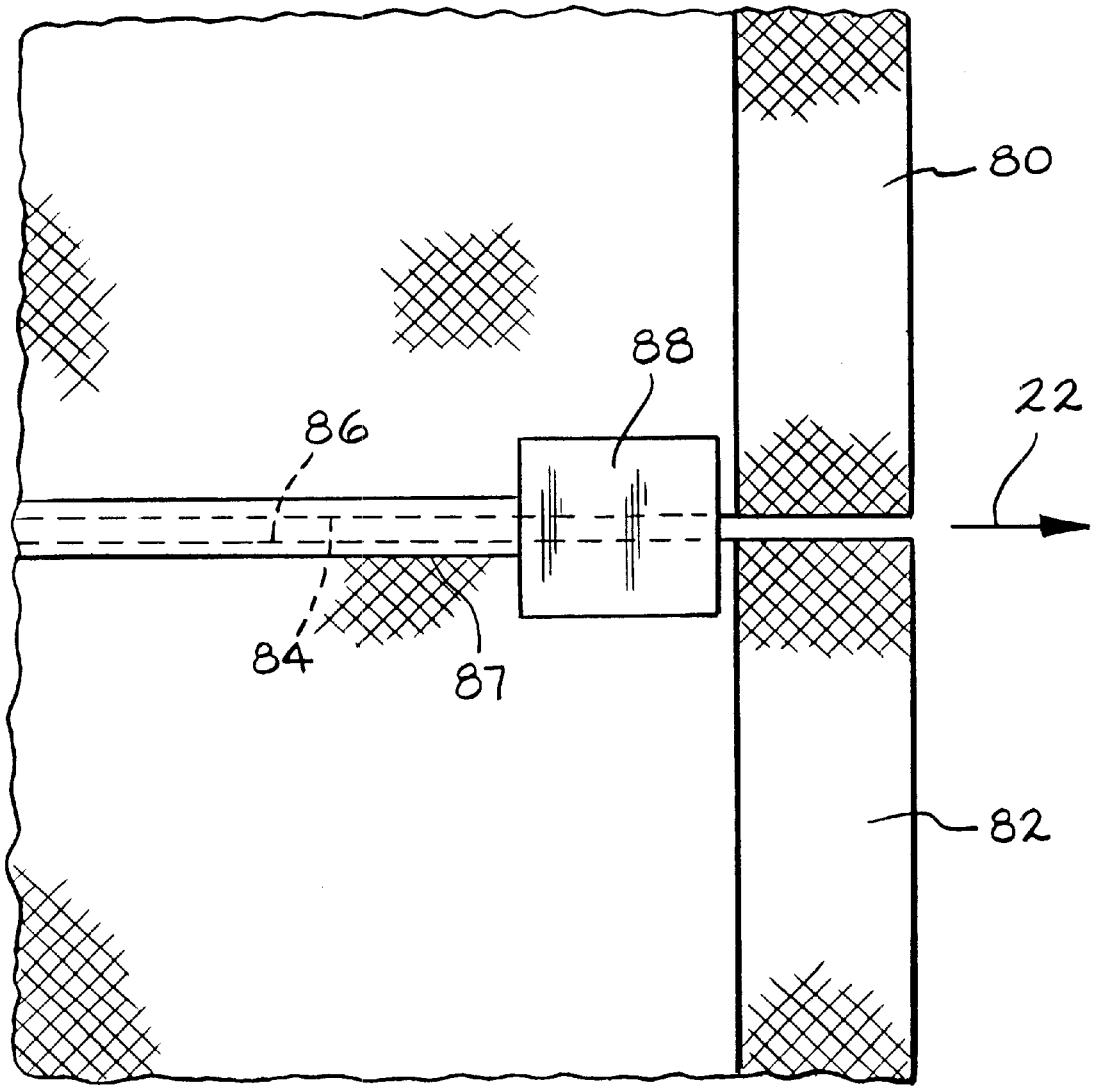
FIG. 5 is a schematic plan view illustrating adjacent edges of netting being fastened together.

It is preferable to fasten the adjacent edges of multiple netting so that the joined netting is as strong as the netting material itself. Preferably, the netting can be joined or fastened together as the netting is dispensed as the carriage travels along the length of the purlins. As schematically illustrated in FIG. 5, a pair of adjacent rolls 80 and 82 of netting are dispensed as the rolls 80 and 82 are moved along the roof structure in the first direction 22. Adjacent edges 84 and 86 of the multiple rolls of netting 80 and 82 are joined together to form a seam, schematically represented at 87 in FIG. 5. The seam 87 can be formed by any suitable manner. For example, workers standing on the carriage 20 can manually fasten the edges 84 and 86 together with mechanical fasteners, such has with ties, cords, hog rings, or clips. The netting can also be secured periodically to the purlins 14 or the rafter beams 12. The edges 84 and 86 can also be fastened together by forming a seam 87 to join the edges 84 and 86 together, such as by stitching. The stitching can be manually done by workers on the platform or, alternatively, by a stitching machine, represented schematically by block 88 in FIG. 5. The stitching machine 88 is mounted on the carriage 20 and can stitch or otherwise fasten the edges 84 and 86 together automatically as the netting is dispensed. Other examples of forming a seam 87 would be using strips fastened to the edges 84 and 86 having mating features, such as hook and loop fasteners, snaps, buttons, zipper mechanisms, or any other suitable mating structures.

The dispensers 30, 32, and 54 can be any suitable framework for rotatably mounting the rolls 34 and 36 of support sheet and the roll of netting, respectively. As shown in FIGS. 1 and 2, the dispensers 30, 32 and 54 include generally vertical members 60 and a pair of turning bars 62 and 64 for directing the support sheet and netting as it is dispensed from the rolls 34 and 36. Preferably, the dispensers 30, 32 and 54 include a clutch mechanism 66 for maintaining longitudinal tension on the support sheets 26 and the netting 24. The tension on the support sheets and the netting helps retain the longitudinal edges of the support sheets and netting on top of the purlins while supporting the insulation material placed thereon. As will be discussed below, the tension on the netting also helps support the netting for providing fall protection to support a worker inadvertently falling onto the netting.

After the insulation material has been placed on the support sheets 26, long sheets of hard roofing material 68, such as metal roof decking, are then attached to the top portion 16 of the purlins 14 over the netting 24, the support sheet 26 and insulation material 40. The hard roofing material can be fastened to the purlins in any suitable manner, such as by threaded fasteners or clips (not shown). The attachment of the hard roofing material presses down on the edges of the portions of the support sheets that are directly underneath so that the support sheet supports the insulation between the purlins. Likewise, the attachment of the hard roofing material secures and supports the netting.

Because the hard roofing material comes in long sheets, typically 30 to 35 feet, and the roofs generally have two sloped sections, it is customary to construct along the width of the sloped section and then proceed along the length of the structure from one end to the other. The workers stand on the previously attached hard roofing material to assemble the next section of roof. The carriage travels along the length of the purlins and is moved by the workers as each section of roof is assembled.

The netting 24 can be any suitable mesh or web material, such as a polymer scrim material, which is sufficiently strong enough to support the weight of a worker inadvertently falling onto the netting. Preferably, the netting is also able to catch falling objects, such as various tools and fasteners which are inadvertently dropped from above the barrier, to protect the workers below the roof structure. By dispensing the netting underneath the rollers 29 of the carriage, the weight of the carriage helps to securely retain or support the netting on top of the purlins. If the carriage is propelled by a winch (not shown) and cable 28, the cable also helps to maintain the position of the carriage on the roof structure to secure the netting if the netting was to be pulled by the weight of a worker who has inadvertently falling onto the netting. Thus, the netting is generally secured by the carriage on one end and by the completed section of the roof structure on the other end. If a powered puller device (not shown) is used to propel the carriage, the puller device is preferably engageable to a clamped position to secure the carriage to the purlins, thereby providing adequate tension on the netting.

Although the netting and support sheets have been shown and described as being dispensed from rolls, it should be understood that the netting and support sheets can be supplied in any suitable format which permits them to be payed out from the moving carriage. For example, if the netting is supplied on rolls, the rolls do not have to be rotatably mounted on the carriage, but can be simply laid on top of the purlins and pulled by the carriage. The netting and support sheets could be supplied in an accordion-style folded manner which spreads out as the netting is dispensed. The netting may also be of an expandable type or controlled mesh spacing type, commonly referred to as a "widener mesh", which can expand or spread out in a lateral and/or longitudinal direction. These types of netting include expandable threads or are specially woven which permits expansion of the netting. If desired, the netting can be manufactured to include expandable regions corresponding to the position between the purlins. The insulation material can also be supplied with the support sheet adhered to one side of thereof, thereby eliminating the need to dispense the support sheet separately from the insulation material.

An alternative to dispensing netting from a roll 56, as shown in FIGS. 1 and 2, is to mount a portable netting machine (not shown) on the carriage 20. The netting machine would produce or stitch a netting from individual spools of string or cord and dispense the netting as the carriage travels along the purlins. Different types of netting can be created for different types of roof structures. For example, the mesh spacing or types of string or cord can be controlled for aesthetic purposes.

Figure 4:
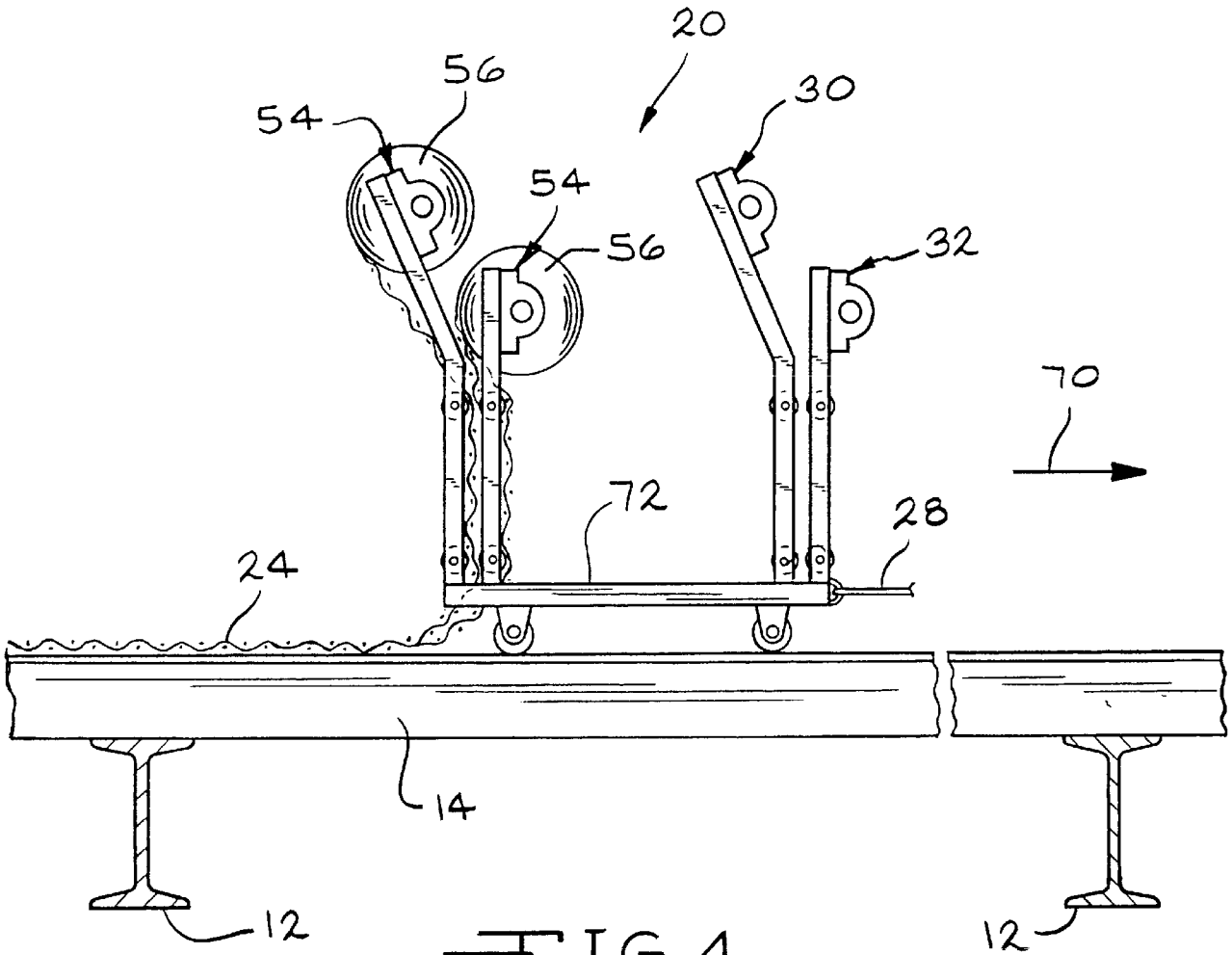
FIG. 4 is side elevational view of a second embodiment of a carriage dispensing a netting, in accordance with the present invention.

Instead of dispensing the netting and the support sheets simultaneously, as described above, the netting could be dispensed separately from the support sheet. For example, as shown in FIG. 4, the carriage 20 can be provided with a supply of netting 24, such as mounted on rolls 56. The carriage 20 is then moved in a second direction, indicated by an arrow 70 along the length of the purlins. Preferably, the carriage 20 is moved from one end of the roof structure to the other end of the roof structure, to dispense the netting across the entire length of the roof. However, if desired, the netting can be dispensed from a first selected portion of the roof structure to another selected portion.

The netting is preferably secured to the purlins 14 and/or rafter beams 12 and the edges of the roof structure in a sufficient manner to provide fall protection which can support the weight of a worker inadvertently falling onto the netting. The netting can be secured to the purlins by any suitable means, such as by the use of straps or clips (not shown). The carriage preferably includes a worker's platform 72 for workers to stand on while operating or moving the carriage. As the carriage travels along the second direction dispensing the netting, the carriage can be periodically stopped, and the workers can secure the netting to the purlins and/or rafter beams.

Once the carriage has reached the end of the roof structure, or a desired portion thereof, the carriage is then supplied with rolls 34 and 36 of support sheet 26. The carriage is then moved in the opposite first direction to dispense the support sheet 26 and construct the roof structure 10, as described above. Thus, as the roof structure 10 is being constructed with the use of the carriage 20, the previously secured netting provides fall protection upstream of the moving carriage. Of course, the rolls of support sheet can be mounted on the carriage during the dispensing of the netting.

Instead of mounting rolls of netting on the carriage, a leading edge of the netting could be fastened to the carriage, and as the carriage travels along the roof structure, the netting is pulled across the roof structure. Supply rolls of netting could then be laid on the ground or mounted on the end of the roof structure.

The principle and mode of operation of this invention have been described in its preferred embodiments. However, it should be noted that this invention may be practiced otherwise than as specifically illustrated and described without departing from its scope.

What is claimed is:

1. A method of providing a roof structure having a plurality of purlins spaced apart from one another in a parallel arrangement, the method comprising:

a. providing a carriage upon which is mounted a supply of support sheet and a supply of netting, wherein the netting and the support sheet include longitudinal edges;

b. constructing a first section of the roof structure comprising purlins, the support sheet, and the netting; and c. moving the carriage along the length of the purlins in a direction away from the first section of the roof structure, wherein movement of the carriage dispenses the support sheet and the netting such that the longitudinal edges of the netting are placed on top of adjacent purlins.

2. The method of claim 1, wherein the netting is dispensed from the carriage such that the netting is underneath the support sheet.

3. The method of claim 1 further comprising the step of applying insulation material on top of the dispensed support sheet.

4. The method of claim 1, wherein the step of constructing the first section of the roof structure includes fastening deck sheets to the purlins.

5. The method of claim 1, wherein the netting is supplied on a roll.

6. The method of claim 5, wherein the roll of netting is supplied in a longitudinally pleated condition and is unfolded as the netting is dispensed from the carriage.

7. The method of claim 1, wherein the supply of netting is dispensed from a dispenser having a clutch mechanism which provides tension to the netting as the netting is dispensed.

8. The method of claim 1, wherein portions of the dispensed netting are fastened to the purlins.

9. The method of claim 1, wherein the supply of netting is expandable in a lateral direction generally perpendicular to the direction that the carriage moves along the length of the purlins.

10. The method of claim 4, wherein the longitudinal edges of the netting and the support sheet are disposed between the purlins and the deck sheets such that the netting and support sheet are supported by the fastening of the deck sheets to the purlins.

11. A method of providing a roof structure having a plurality of purlins spaced apart from one another in a parallel arrangement, the method comprising:

a. providing a carriage carrying first and second supplies of netting;

b. providing a supply of support sheet;

c. constructing a first section of the roof structure comprising purlins, the support sheet, and the first and second supplies of netting;

d. moving the carriage along the length of the purlins in a direction away from the first section of the roof structure, wherein movement of the carriage dispenses the support sheet and the first and second supplies of netting such that edges of the first and second supplies of netting are dispensed adjacent one another; and e. fastening the adjacent edges of the first and second supplies of netting together.

12. The method of claim 11, wherein the edges of the first and second supplies of netting are fastened together by stitching.

13. The method of claim 12, wherein the stitching is performed by a stitching machine mounted on the carriage such that the edges of the first and second supplies of netting are simultaneously fastened together as the carriage moves along the purlins.

14. The method of claim 11, wherein the edges of the first and second supplies of netting are fastened together by mechanical fasteners.

15. The method of claim 11 further comprising the step of applying insulation material on top of the dispensed support sheet.

16. The method of claim 11, wherein the step of constructing the first section of the roof structure includes fastening deck sheets to the purlins.

17. The method of claim 11, wherein the first and second supplies of netting are supplied on rolls.

18. The method of claim 17, wherein the rolls of netting are supplied in a longitudinally pleated condition and is unfolded as the netting is dispensed from the carriage.

19. The method of claim 11, wherein portions of the dispensed netting are fastened to the purlins.

20. The method of claim 11, wherein the first and second supplies of netting are expandable in a lateral direction generally perpendicular to the direction that the carriage moves along the length of the purlins.

21. The method of claim 11, wherein the first and second supplies of netting are dispensed from the carriage such that the edges of the netting are placed on top of adjacent purlins.

22. The method of claim 16, wherein the edges of the first and second supplies of netting are disposed between the purlins and the deck sheets such that the first and second supplies of netting are supported by the fastening of the deck sheets to the purlins.

* * * * *

UNITED STATES PATENT AND TRADEMARK OFFICE

CERTIFICATE OF CORRECTION

PATENT NO. : 6,363,684 B1
DATED : April 2, 2002
INVENTOR(S) : Alderman

It is certified that error appears in the above-identified patent and that said Letters Patent is hereby corrected as shown below:

Title page,
Item [73], please delete the following "Owens Corning Fiberglas Technology, Inc., Summit, IL (US)"

Signed and Sealed this

Eighteenth Day of June, 2002

*Attest:*

*Attesting Officer*

JAMES E. ROGAN
*Director of the United States Patent and Trademark Office*